US008888030B2

(12) United States Patent
Zhang

(10) Patent No.: US 8,888,030 B2
(45) Date of Patent: Nov. 18, 2014

(54) PAPER SHREDDER

(71) Applicant: Primax Electronics Ltd., Taipei (TW)

(72) Inventor: Bing-Huai Zhang, Taipei (TW)

(73) Assignee: Primax Electronics Ltd., Neihu (TW)

( * ) Notice: Subject to any disclaimer, the term of this patent is extended or adjusted under 35 U.S.C. 154(b) by 168 days.

(21) Appl. No.: 13/664,217

(22) Filed: Oct. 30, 2012

(65) Prior Publication Data

US 2014/0048637 A1 Feb. 20, 2014

(30) Foreign Application Priority Data

Aug. 15, 2012 (CN) ..... 2012 1 0290156

(51) Int. Cl.
*B02C 18/22* (2006.01)

(52) U.S. Cl.
USPC ..... 241/225; 241/236

(58) Field of Classification Search
USPC ..... 241/224, 225, 236
See application file for complete search history.

(56) References Cited

U.S. PATENT DOCUMENTS 8,672,251 B2 * 3/2014 Aries et al. ..... 241/225

* cited by examiner

*Primary Examiner* — Mark Rosenbaum
(74) *Attorney, Agent, or Firm* — Kirton McConkie; Evan R. Witt

(57) ABSTRACT

A paper shredder includes an upper cover and a pressing structure. The pressing structure includes a base plate and a retractable member. The retractable member includes a push rod, a first sleeve, and an elastic element. The first sleeve includes a first hollow portion. The push rod is inserted into the first hollow portion of the first sleeve. The elastic element is disposed within the first hollow portion of the first sleeve. When the paper stack is contacted with the base plate to push the push rod, the push rod is transferred through the first hollow portion of the first sleeve and the elastic element is pushed by the push rod. Consequently, the elastic element generates an elastic force to press the paper stack.

8 Claims, 6 Drawing Sheets

PAPER SHREDDER

FIELD OF THE INVENTION

The present invention relates to a paper shredder, and more particularly to a paper shredder with a retractable member for pressing papers.

BACKGROUND OF THE INVENTION

FIG. 1 is a schematic partial perspective view illustrating a conventional paper shredder. As shown in FIG. 1, the conventional paper shredder 10 comprises an upper cover 11 and a paper-pressing structure 12. For allowing a stack of papers (also referred as a paper stack) to be smoothly introduced into the paper shredder 10, the upper cover 11 of the conventional paper shredder 10 is usually equipped with the paper-pressing structure 12 for pressing the paper stack into the paper shredder 10.

FIG. 2 is a schematic cross-sectional view illustrating the paper-pressing structure of the conventional paper shredder. As shown in FIG. 2, the paper-pressing structure 12 comprises a base plate 13, plural posts 14, a frame 15, and plural elastic elements 16. The frame 15 comprises plural openings 17. The frame 15 is disposed on a bottom surface of the upper cover 11. The plural posts 14 are disposed on a top surface of the base plate 13. The plural posts 14 are penetrated through the plural openings 17 of the frame 15, respectively. The elastic elements 16 are sheathed around respective posts 14. A first terminal of the elastic element 16 is sustained against the top surface of the base plate 13. A second terminal of the elastic element 16 is sustained against a bottom surface of the frame 15.

When the base plate 13 is contacted with and pushed by the paper stack, the plural posts 14 are correspondingly moved with the base plate 13 and toward the frame 15. Consequently, the posts 14 are inserted into the space between the frame 15 and the upper cover 11 through the openings 17 of the frame 15, respectively. In other words, the distance between the base plate 13 and the frame 15 is gradually reduced.

Since the second terminal of the elastic element 16 is sustained against the bottom surface of the frame 15, during the base plate 13 is moved relative to the frame 15, the elastic element 16 is pushed by the base plate 13. As the elastic element 16 is subjected to deformation, the elastic element 16 generates an elastic force. In response to the elastic force, the paper stack is pressed down. Consequently, the purpose of pressing the papers is achieved.

From the above discussions, since the use of the conventional paper-pressing structure 12 can assist the paper shredder 10 in pressing the papers, the paper stack can be introduced into the paper shredder 10 more easily. However, there are still some drawbacks. For example, since it is necessary to install an additional space between the frame 15 and the upper cover 11 to accommodate the posts 14 and allow the posts 14 to be moved therein, the volume of the upper cover 11 is increased. The volume increase of the upper cover 11 is detrimental to minimization of the paper shredder 10.

SUMMARY OF THE INVENTION

The present invention provides a paper shredder with a reduced inner space.

In accordance with an aspect of the present invention, there is provided a paper shredder. The paper shredder includes an upper cover and a pressing structure. The pressing structure is disposed under the upper cover. The pressing structure includes a base plate and a retractable member. The base plate may be contacted with a paper stack. The retractable member is connected with the base plate and the upper cover. The retractable member includes a push rod, a first sleeve, and an elastic element. The first sleeve includes a first hollow portion. The push rod is inserted into the first hollow portion of the first sleeve. The elastic element is disposed within the first hollow portion of the first sleeve. When the paper stack is contacted with the base plate to push the push rod, the push rod is transferred through the first hollow portion of the first sleeve, and the elastic element is pushed by the push rod, so that the elastic element generates an elastic force to press the paper stack.

In an embodiment, the retractable member further includes a second sleeve. The second sleeve includes a second hollow portion, and the first sleeve is inserted into the second hollow portion of the second sleeve. When the paper stack is contacted with the base plate to push the push rod, the push rod is transferred through the first hollow portion of the first sleeve, the first sleeve is transferred through the second hollow portion of the second sleeve, and the elastic element is pushed by the push rod, so that the elastic element generates the elastic force to press the paper stack.

In an embodiment, a diameter of the second hollow portion is larger than a diameter of the first sleeve.

In an embodiment, the elastic element is a spring.

In an embodiment, the retractable member is located at a corner of a top surface of the base plate.

In an embodiment, a diameter of the first hollow portion is larger than a diameter of the push rod.

In an embodiment, a first terminal of the elastic element is fixed on an end of the push rod, and a second terminal of the elastic element is fixed on the upper cover.

In an embodiment, the push rod includes a receiving space. In addition, the elastic element is further disposed within the receiving space of the push rod.

In an embodiment, the paper shredder includes a casing, a shredding knife assembly, a paper placement platform, and a feeding roller assembly. The shredding knife assembly is disposed within the casing. The paper placement platform is disposed over the shredding knife assembly for supporting the paper stack. The feeding roller assembly is arranged between the paper placement platform and the shredding knife assembly and exposed through the paper placement platform for feeding the paper stack to the shredding knife assembly.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
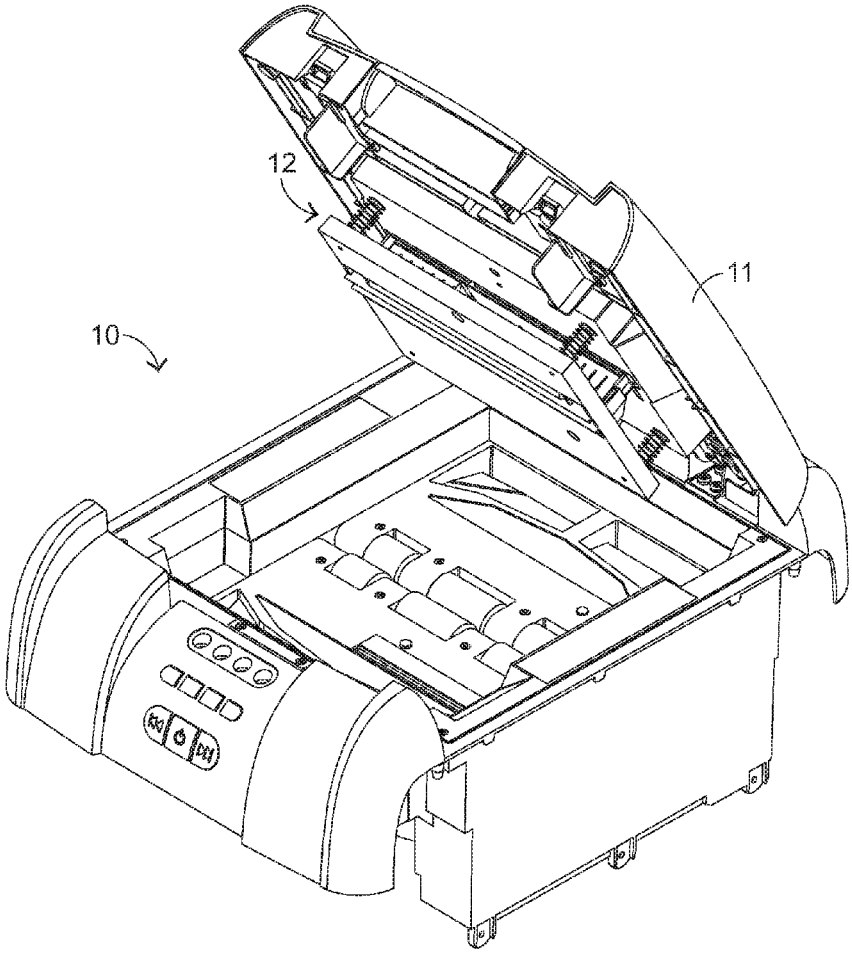
FIG.1 PRIOR ART
FIG. 1 is a schematic partial perspective view illustrating a conventional paper shredder.
Figure 2:
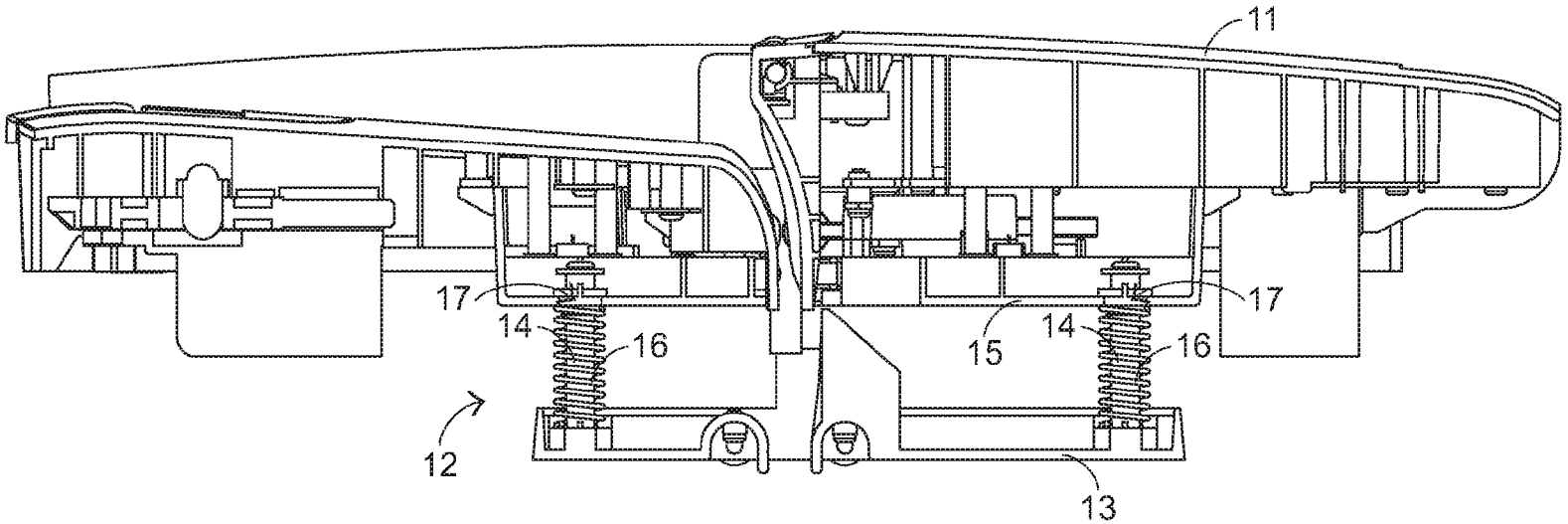
FIG.2 PRIOR ART
FIG. 2 is a schematic cross-sectional view illustrating the paper-pressing structure of the conventional paper shredder.
Figure 3:
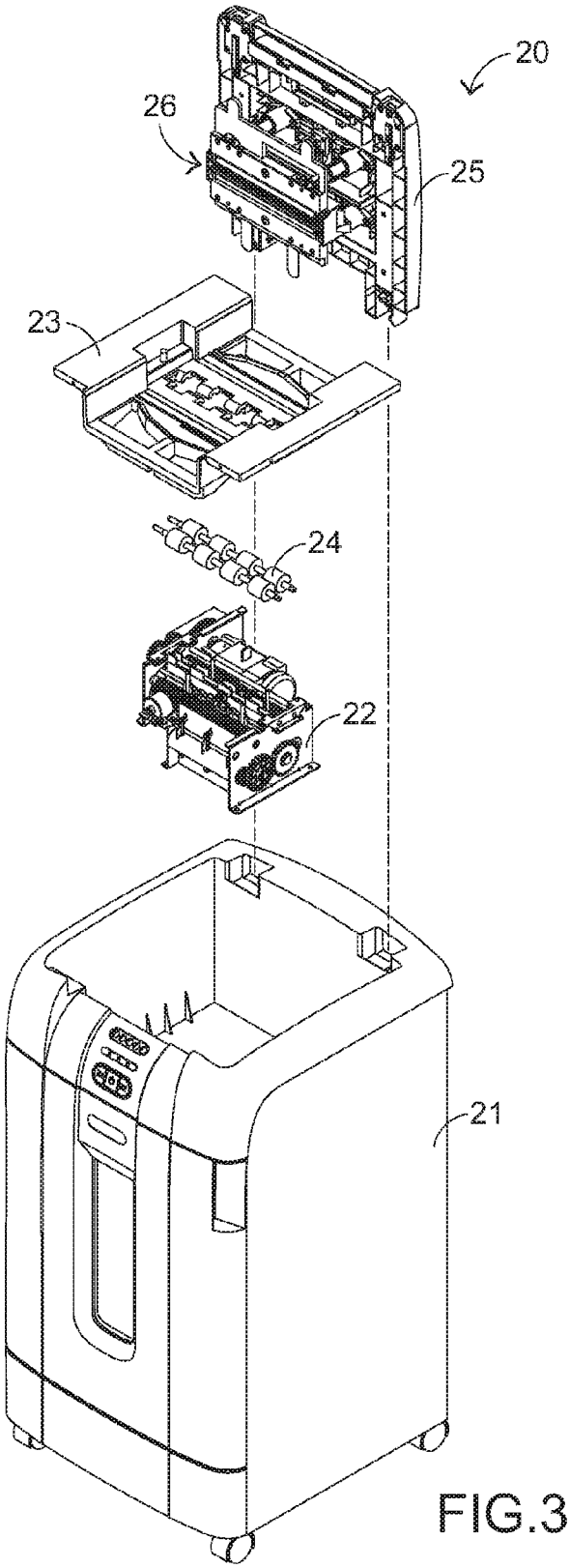
FIG. 3 is a schematic exploded view illustrating a paper shredder according to an embodiment of the present invention.

FIG. 3 is a schematic exploded view illustrating a paper shredder according to an embodiment of the present invention. As shown in FIG. 3, the paper shredder 20 comprises a casing 21, a shredding knife assembly 22, a paper placement platform 23, a feeding roller assembly 24, an upper cover 25, and a pressing structure 26.

The shredding knife assembly 22 is disposed within the casing 21 for cutting a paper stack into plural small pieces (e.g. strips or fine particles). The paper placement platform 23 is disposed over the shredding knife assembly 22 for supporting the paper stack. The feeding roller assembly 24 is arranged between the paper placement platform 23 and the shredding knife assembly 22, and exposed through the paper placement platform 23. The feeding roller assembly 24 is used for feeding the paper stack to the shredding knife assembly 22 in order to perform the shredding operation. The operating principles and the shredding mechanism of the paper shredder 20 of the present invention are substantially identical to those of the conventional paper shredder. Consequently, the shredding mechanism of the paper shredder 20 is presented herein for purpose of illustration and description only, but is not limited thereto.

Please refer to FIG. 3 again. The upper cover 25 is disposed over the paper placement platform 23. Moreover, the upper cover 25 is pivotally coupled with the casing 21 of the paper shredder 20, and rotatable relative to the paper shredder 20. The pressing structure 26 is disposed under the upper cover 25. When the upper cover 25 is rotated relative to the paper placement platform 23 to allow the pressing structure 26 and the paper stack on the paper placement platform 23 to be contacted with each other, the paper stack is pressed by the pressing structure 26. Consequently, the papers can be pressed into the paper shredder 20.

Figure 4:
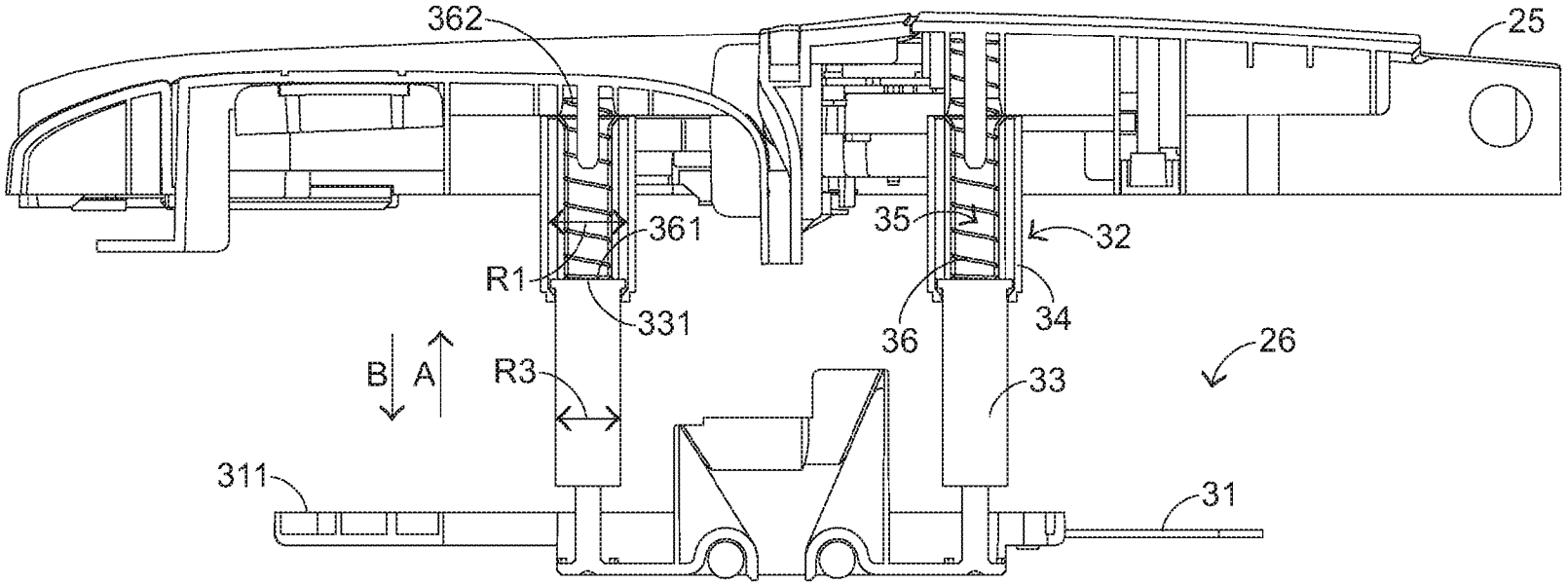
FIG. 4 is a schematic cross-sectional view illustrating a pressing structure according to a first embodiment of the present invention.

Hereinafter, the pressing structure 26 according to a first embodiment of the present invention will be illustrated with reference to FIG. 4. FIG. 4 is a schematic cross-sectional view illustrating a pressing structure according to a first embodiment of the present invention. As shown in FIG. 4, the pressing structure 26 comprises a base plate 31 and plural retractable members 32. The base plate 31 is disposed under the upper cover 25 to be contacted with the paper stack. The retractable member 32 is connected with the base plate 31 and the upper cover 25. In this embodiment, the retractable members 32 are respectively located at four corners of a top surface 311 of the base plate 31 in order to achieve both functions of saving cost and pressing papers. It is noted that the number and the positions of the retractable members 32 may be varied according to the practical requirements.

Please refer to FIG. 4 again. The retractable member 32 comprises a push rod 33, a first sleeve 34, and an elastic element 36. The first sleeve 34 comprises a first hollow portion 35. The elastic element 36 is disposed within the first hollow portion 35 of the first sleeve 34. As shown in FIG. 4, the push rod 33 is inserted into the first hollow portion 35 of the first sleeve 34, and the push rod 33 is movable relative to the first sleeve 34. For allowing the push rod 33 to be smoothly moved relative to the first sleeve 34, the diameter R1 of the first hollow portion 35 is larger than the diameter R3 of the push rod 33.

In this embodiment, the elastic element 36 is a spring such as a compression spring. Moreover, the push rod 33 is a plastic solid rod. A first terminal 361 of the elastic element 36 is sustained against an end 331 of the push rod 33, and a second terminal 362 of the elastic element 36 is sustained against a bottom surface of the upper cover 25.

When the paper stack is contacted with the base plate 31 to push the push rod 33 to be moved in a direction A, the push rod 33 is transferred through the first hollow portion 35 of the first sleeve 34. Consequently, the overall height of the retractable member 32 is reduced to the height of the first sleeve 34. At the same time, the elastic element 36 is pushed by the push rod 33. As the elastic element 36 is subjected to deformation, the elastic element 36 generates an elastic force in a direction B, wherein the direction B is reverse to the direction A. In response to the elastic force, the paper stack is pressed down. Consequently, the purpose of pressing the papers is achieved.

For preventing from unexpected deformation (e.g. curve deformation or tilt deformation) of the elastic element 36 during the elastic element 36 is compressed, the pressing structure 26 of this embodiment may further use the known fixing means. For example, via an adhesive, the first terminal 361 of the elastic element 36 may be fixed on the end 331 of the push rod 33, and the second terminal 362 of the elastic element 36 may be fixed on the bottom surface of the upper cover 25. It is noted that the way of fixing the elastic element 36 is presented herein for purpose of illustration and description only. In addition, the fixing means is not limited to the use of the adhesive.

Figure 5:
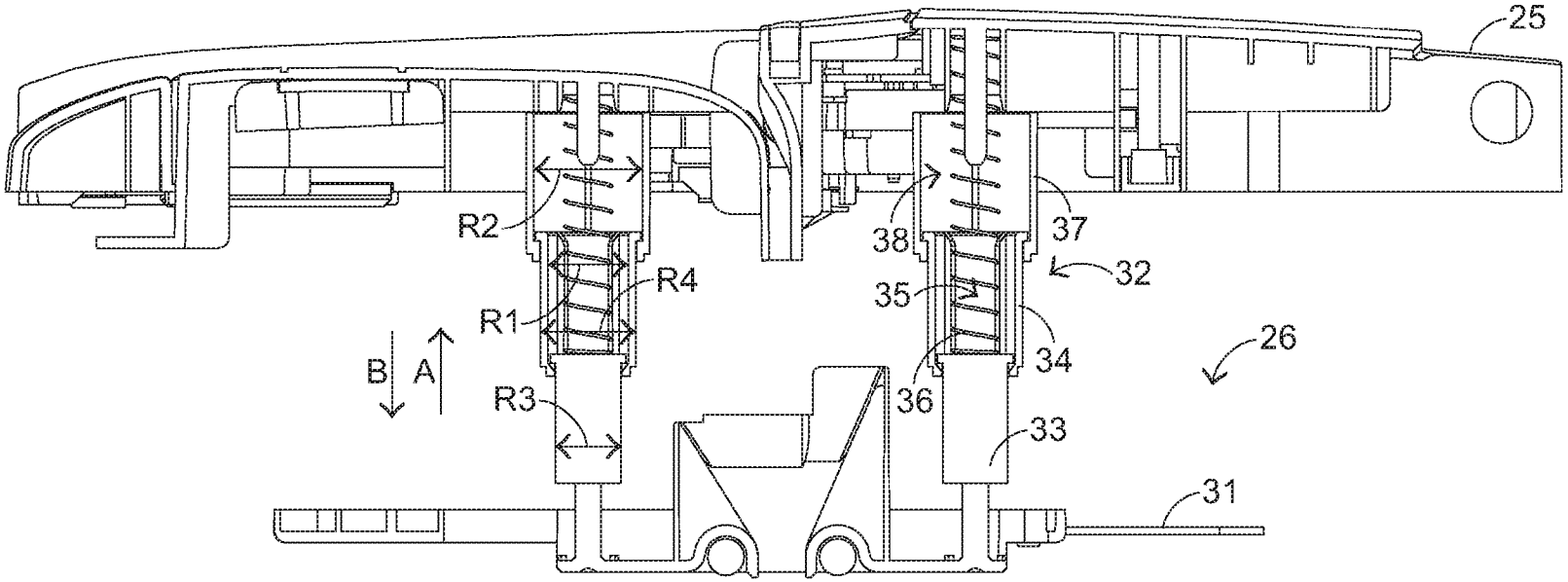
FIG. 5 is a schematic cross-sectional view illustrating a pressing structure according to a second embodiment of the present invention.

Hereinafter, a pressing structure according to a second embodiment of the present invention will be illustrated with reference to FIG. 5. FIG. 5 is a schematic cross-sectional view illustrating a pressing structure according to a second embodiment of the present invention. As shown in FIG. 5, the pressing structure 26 comprises a base plate 31 and plural retractable members 32. The base plate 31 is disposed under the upper cover 25 to be contacted with the paper stack. The retractable member 32 is connected with the base plate 31 and the upper cover 25. As shown in FIG. 5, the retractable member 32 comprises a push rod 33, a first sleeve 34, a second sleeve 37, and an elastic element 36. The first sleeve 34 comprises a first hollow portion 35. The second sleeve 37 comprises a second hollow portion 38.

As shown in FIG. 5, the push rod 33 is inserted into the first hollow portion 35 of the first sleeve 34, and the push rod 33 is movable relative to the first sleeve 34. The first sleeve 34 is inserted into the second hollow portion 38 of the second sleeve 37, and the first sleeve 34 is movable relative to the second sleeve 37. Consequently, the overall height of the retractable member 32 may be reduced to the height of the second sleeve 37. In addition, the elastic element 36 is disposed within the first hollow portion 35 and the second hollow portion 38.

For allowing the push rod 33 to be smoothly moved relative to the first sleeve 34, the diameter R1 of the first hollow portion 35 is larger than the diameter R3 of the push rod 33. Moreover, for allowing the first sleeve 34 to be smoothly moved relative to the second sleeve 37, the diameter R2 of the second hollow portion 38 is larger than the diameter R4 of the first sleeve 34.

When the paper stack is contacted with the base plate 31 to push the push rod 33 to be moved in a direction A, the push rod 33 is firstly transferred through the first hollow portion 35 of the first sleeve 34 and then transferred through the second hollow portion 38 of the second sleeve 37. Correspondingly, the first sleeve 34 is transferred through the second hollow portion 38 of the second sleeve 37. At the same time, the elastic element 36 is pushed by the push rod 33. As the elastic element 36 is subjected to deformation, the elastic element 36 generates an elastic force in the direction B, wherein the direction B is reverse to the direction A. In response to the elastic force, the paper stack is pressed down. Consequently, the purpose of pressing the papers is achieved.

Except that the retractable member 32 of the pressing structure 26 of the second embodiment further comprises the second sleeve 37, the operating principles of the pressing structure 26 of the second embodiment are similar to those of the pressing structure 26 of the first embodiment as shown in FIG. 4. As the number of the sleeves of the retractable member 32 is increased, once the retractable member 32 is completely compressed, the retractable member 32 has the minimum overall height. In other words, since the arrangement of the second sleeve 37 of the pressing structure 26 according to the second embodiment of the present invention may reduce the overall height of the retractable member 32 in the compressed state, the distance between the paper placement platform 23 and the upper cover 25 is increased. Under this circumstance, the paper placement platform 23 can accommodate more papers of the paper stack.

Figure 6:
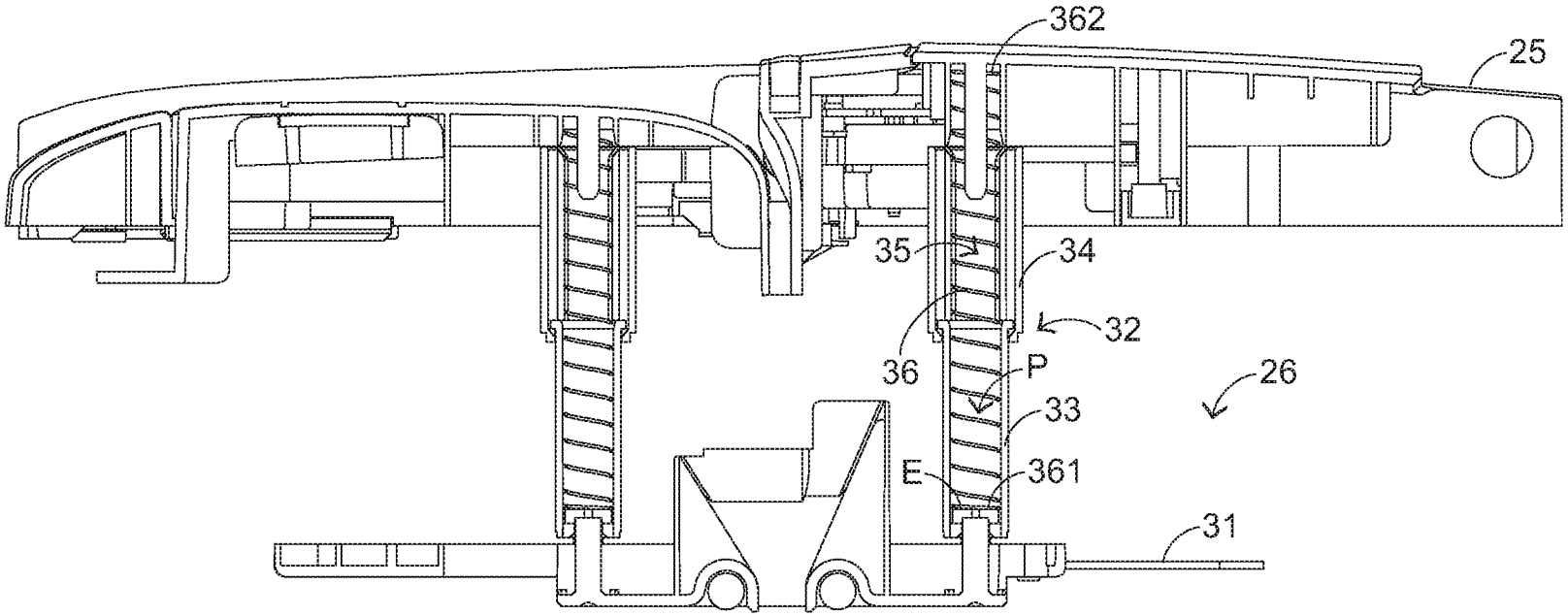
FIG. 6 is a schematic cross-sectional view illustrating a pressing structure according to a third embodiment of the present invention.

Hereinafter, a pressing structure according to a third embodiment of the present invention will be illustrated with reference to FIG. 6. FIG. 6 is a schematic cross-sectional view illustrating a pressing structure according to a third embodiment of the present invention. As shown in FIG. 6, the pressing structure 26 comprises a base plate 31 and plural retractable members 32. The base plate 31 is disposed under the upper cover 25 to be contacted with the paper stack. The retractable member 32 is connected with the base plate 31 and the upper cover 25. As shown in FIG. 6, the retractable member 32 comprises a push rod 33, a first sleeve 34, and an elastic element 36. The push rod 33 comprises a receiving space P. The first sleeve 34 comprises a first hollow portion 35. The elastic element 36 is disposed within the receiving space P and the first hollow portion 35.

Except for the following items, the operating principles of the pressing structure 26 of the third embodiment are similar to those of the pressing structure 26 of the first embodiment as shown in FIG. 4. For example, in the pressing structure 26 of the third embodiment, the push rod 33 further comprises the receiving space P, a first terminal 361 of the elastic element 36 is sustained against an end E of the receiving space P, and a second terminal 362 of the elastic element 36 is sustained against the bottom surface of the upper cover 25.

For preventing from unexpected deformation (e.g. curve deformation or tilt deformation) of the elastic element 36 during the elastic element 36 is compressed, the pressing structure 26 of this embodiment may further use the known fixing means. For example, via an adhesive, the first terminal 361 of the elastic element 36 may be fixed on the end E of the receiving space P, and the second terminal 362 of the elastic element 36 may be fixed on the bottom surface of the upper cover 25. It is noted that the way of fixing the elastic element 36 is presented herein for purpose of illustration and description only. In addition, the fixing means is not limited to the use of the adhesive.

From the above descriptions, the present invention provides a paper shredder with a retractable member for pressing papers. The retractable member is arranged between an upper cover and a base plate. When the paper stack is contacted with the base plate to push the push rod, the push rod is transferred through the first hollow portion of the first sleeve. Consequently, the overall height of the retractable member is reduced. At the same time, the elastic element is pushed by the push rod, so that the elastic element generates an elastic force to press the paper stack. In other words, the use of the pressing structure of the present invention can achieve the function of pressing papers without the need of installing an additional space for allowing movement of the retractable member. As a result, the overall volume of the paper shredder can be reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper shredder comprising:
- a casing;
- a shredding knife assembly disposed within said casing;
- a paper placement platform disposed over said shredding knife assembly for supporting said paper stack;
- a feeding roller assembly arranged between said paper placement platform and said shredding knife assembly and exposed through said paper placement platform for feeding said paper stack to said shredding knife assembly;
- an upper cover; and
- a pressing structure, said pressing structure being disposed under said upper cover, wherein said pressing structure comprises:
  - a base plate to be contacted with a paper stack; and
  - a retractable member connected with said base plate and said upper cover, and comprising:
    - a push rod;
    - a first sleeve comprising a first hollow portion, wherein said push rod is inserted into said first hollow portion of said first sleeve; and
    - an elastic element disposed within said first hollow portion of said first sleeve, wherein when said paper stack is contacted with said base plate to push said push rod, said push rod is transferred through said first hollow portion of said first sleeve, and said elastic element is pushed by said push rod, so that said elastic element generates an elastic force to press said paper stack.

2. The paper shredder according to claim 1, wherein said retractable member further comprises a second sleeve, wherein said second sleeve comprises a second hollow portion, and said first sleeve is inserted into said second hollow portion of said second sleeve, wherein when said paper stack is contacted with said base plate to push said push rod, said push rod is transferred through said first hollow portion of said first sleeve, said first sleeve is transferred through said second hollow portion of said second sleeve, and said elastic element is pushed by said push rod, so that said elastic element generates said elastic force to press said paper stack.

3. The paper shredder according to claim 2, wherein a diameter of said second hollow portion is larger than a diameter of said first sleeve.

4. The paper shredder according to claim 1, wherein said elastic element is a spring.

5. The paper shredder according to claim 1, wherein said retractable member is located at a corner of a top surface of said base plate.

6. The paper shredder according to claim 1, wherein a diameter of said first hollow portion is larger than a diameter of said push rod.

7. The paper shredder according to claim 1, wherein a first terminal of said elastic element is fixed on an end of said push rod, and a second terminal of said elastic element is fixed on said upper cover.

8. The paper shredder according to claim 1, wherein said push rod comprises a receiving space, wherein said elastic element is further disposed within said receiving space of said push rod.

* * * * *